United States Patent [19]

Chang

[11] Patent Number: 4,912,767

[45] Date of Patent: Mar. 27, 1990

[54] DISTRIBUTED NOISE CANCELLATION SYSTEM

[75] Inventor: Robert W. Chang, Oakton, Va.

[73] Assignee: International Business Machines Corporation, Armonk, N.Y.

[21] Appl. No.: 167,619

[22] Filed: Mar. 14, 1988

[51] Int. Cl.[4] ..... G10L 5/06

[52] U.S. Cl. ..... 381/47; 381/46

[58] Field of Search ..... 381/41–47, 381/71, 94; 364/513.5

[56] References Cited

U.S. PATENT DOCUMENTS

| | | | |
|---|---|---|---|
| 4,594,695 | 6/1986 | Garconnat et al. | 381/71 |
| 4,625,083 | 11/1986 | Poikela | 381/46 |
| 4,630,305 | 12/1986 | Borth et al. | 381/94 |
| 4,649,505 | 3/1987 | Zinser | 381/94 |
| 4,737,976 | 4/1988 | Borth et al. | 381/46 |

FOREIGN PATENT DOCUMENTS 2188763 10/1987 United Kingdom .

OTHER PUBLICATIONS

Parsons, "Voice and Speech Processing", McGraw-Hill, 1976, pp. 345–369.

Boll, "Suppression of Acoustical Noise in Speech Using Spectral Subtraction", IEEE Trans ASSP, vol. ASSP 27, No. 2, 4/79.

Harrison, "Adaptive Noise Cancellation in a Fighter Cockpit Environment", IEEE, 1984, pp. 18A.4.1–1-8A.4.4.

*Primary Examiner*—Gary V. Harkcom
*Assistant Examiner*—John A. Merecki
*Attorney, Agent, or Firm*—Douglas M. Clarkson

[57] ABSTRACT

A method and system for cancelling noise from sources that are distributed over a region, whereby two sensors are located so that a first sensor will detect both voice signals and noise signals, and a second sensor will detect only the noise signals. The voice signals picked up at the second sensor are negligible, and the noise signals picked up at both sensors are correlated. The signals output from each sensor are connected to a predetermined number of narrowband filters in order to divide each respective signal into a predetermined number of frequencies, such as 15 for example. Thereafter, both signals are combined to cancel effectively the noise component from the signal output having both voice and noise to leave a voice signal that is substantially noise free.

7 Claims, 3 Drawing Sheets

DISTRIBUTED NOISE CANCELLATION SYSTEM

BACKGROUND OF THE INVENTION

1. Field of the Invention

The present invention, generally, relates to a method and a system for cancelling noise from noise-corrupted speech and, more particularly, to an improved method and system for rendering speech recognizable in a high noise environment, particularly where noise is distributed.

One glance into the cockpit of today's commercial airliner would give an idea of the hands-busy, eyes-busy environment that exists there, and this is more true of the cockpit in today's military aircraft. The military has solved their problem somewhat by the use of voice-actuated controls for many activities, such as located in the cockpit of a fighter aircraft, and this has been accomplished through the use of voice recognition systems.

It was realized early that, due to the relatively high noise in the cockpit of a fighter aircraft, some form of noise cancellation was required, and from that need, an adaptive filter noise cancellation technique was developed that has become a standard in the industry. More recently, that technique was tried in military helicopters, and it was found to be ineffective.

2. Description of the Prior Art

It is understandable that the presence of high levels of noise in an audio signal will produce a substantial reduction in the intelligibility of speech, and it has been found that the most advanced voice recognition equipment is seriously ineffective in recognizing the simplest words in the high noise levels encountered in the cockpit of today's tactical fighter aircraft. A technique that was proposed by Bernard Widrow et al. in 1975, known as Adaptive Noise Cancellation (or ANC), has been tested extensively at the Research Laboratory of Electronics at the Massachusetts Institute of Technology.

The Widrow technique is described in an article that is entitled "Adaptive Noise Cancelling: Principles and Applications", Proc. IEEE, Vol. 63, No. 12, December, 1975.

During the M.I.T. tests, some improvements were developed in the Widrow technique, such as placements for the two microphones in a fighter cockpit environment as being one inside the oxygen facemask of the pilot and the second microphone outside the facemask. The one microphone, called the "primary" microphone, is located to sense, or to detect, the voice of the pilot plus the noise.

The second, or "reference", microphone is located to sense, or detect, principally the noise. By locating the reference microphone outside the oxygen facemask, very little of the pilot's voice is picked up.

The engineers at M.I.T. learned also that it is better to have the signal-to-noise ratio of the primary microphone large compared to the signal-to-noise ratio of the reference microphone, so that the adaptive filter can be kept as small as possible. Otherwise, the adaptive filter must either estimate the delay between the primary and reference signals or have a long impulse response in order to provide good cancellation of the noise from the primary signal.

A report of the M.I.T. engineers is given in a paper entitled "Adaptive Noise Cancellation in a Fighter Cockpit Environment" by Harrison, Lim and Singer, 1984 IEEE, pages 18A.4.1 through 18A.4.4.

With all of the expertise of these M.I.T. engineers, the conclusion was that the Adaptive Noise Cancellation technique of Widrow, while effective enough in an environment with a localized noise source, degrades in performance when there is more than one noise source present or when the noise source is distributed over a region. Actually, the many sources of noise in a helicopter make the Adaptive Noise Cancellation technique virtually ineffective in that high noise environment where the noise sources are distributed over a wide region. While those experts in the field departed to study the use of additional reference microphones in a distributed noise environment, the present invention proceeds with the development of a unique solution to this perplexing problem.

A review of the prior patent art reveals very little to assist in developing a solution such as provided by the present invention. For example, U.S. Pat. No. 4,625,083 to Poikela is concerned with providing a voice operated switch that is capable of distinguishing between voice and noise. By using one microphone primarily for speech and one microphone primarily for ambient noise signals, each of these groups of signals have a certain sound pressure level, and since it is desired to have the sound pressure level of the speech signal always exceed that of the noise signal, this is accomplished in two ways. One way is by placing the two microphones in predetermined locations so that the sound pressure level distinctions are realized, and another way is by limiting the width of the frequencies, like that customarily used in telephone receivers. A typical frequency range is 100 hertz to 4 kilohertz, but a narrower frequency range of 250 hertz to 3.5 kilohertz is termed as being satisfactory. By connecting both signals to a differential amplifier, an output will result when there is speech, and there is no output when there is no speech.

U.S. Pat. No. 4,649,505 to Zinser, Jr. et al. is an example of another attempt to improve on the basic adaptive filter of Widrow, identified supra, but this effort is for the purpose of eliminating crosstalk between speech and noise signals. It discloses the use of a speech input, a noise input and a reference input with a reference noise portion and a crosstalk speech portion to a digital signal processing microcontroller, a read-only-memory and a random access memory, from which the signals are processed digitally. After the inputs are converted first from analog to digital signals, they are converted next from digital serial signals to digital parallel signals for further processing. There is no mention of the problem with which the present invention is concerned.

U.S. Pat. No. 4,658,426 to Chabries et al. discloses several different forms of noise suppression devices for use where the signal-to-noise ratio is poor at the input and where the characteristics of the adaptive filter adjust automatically to variations in the input signal. These adjustments utilize time and frequency domains in making the adaptive filter adjustments in order to filter noise, and a mathematical description is given in substantial detail for devices constructed to take advantage of such premises. A use for such devices is given as one tuned to filter out the normal operating sound of machinery as "noise" and to detect the unusual sound of a worn or failed component of the machinery. However, these are illustrations of localized noise, with which the adaptive filter type of device is capable of functioning quite adequately, according to the M.I.T. reference, supra.

U.S. Pat. No. 4,672,674 to Clough et al. discloses a system utilizing two specially built microphones that have good near field response and poor far field response to produce signals with noise components having high correlation. Like the Poikela U.S. Pat. No. 4,625,083 above, the outputs from these microphones are connected to a filter to remove frequencies outside the range of 300 Hz to between 5 and 8 kHz. The signals then pass to analog-to-digital converters, to microprocessor circuitry having delay and other capability, to achieve weighted-factor-samples for further processing. While this prior patent discloses the use of two microphones, it also suggests that a logical extension of this use is to use three or more microphones, one for speech and the outputs of the other microphones being used to cancel the noise in the signal from the one microphone.

On the other hand, the present invention takes a different approach to providing a solution to the problem of cancelling distributed noise from a speech signal, because tests show that the Adaptive Noise Cancellation technique of the prior art degrades in performance when the noise is distributed over a region.

OBJECTS AND SUMMARY OF THE INVENTION

It is a principal object of the present invention to provide a system for cancelling distributed noise from a signal that contains noise-degraded speech.

An important object of the invention is to provide a method for cancelling distributed noise from a voice signal.

Another object of the present invention is to provide a new and improved method and means for cancelling distributed noise from a voice signal.

Yet another object of the invention is to provide a noise cancellation method and system that is effective in a high distributed noise environment.

Still another object of the invention is to provide an effective noise cancellation method and system for use with a speech (or voice) recognition system.

A further object of the present invention is to provide a noise cancellation method and system that will function effectively with standard speech (or voice) sensing pickups.

A still further object of the present invention is to provide a noise cancellation method and system that will function effectively with a standard speech (or voice) recognition system in a helicopter environment.

Briefly, a method and system that is constructed and arranged in accordance with the present invention includes two sensors, or microphones, located so that a first sensor will detect both voice and noise and a second sensor will detect principally only the noise. The voice picked up at the second sensor is negligible, and the noise that is picked up at both sensors is correlated. The signal output from each sensor is connected to means to divide each respective signal output into a predetermined number of frequencies. Then, both signal outputs are connected to a circuit to cancel effectively the noise component from the signal output with both voice and noise.

BRIEF DESCRIPTION OF THE DRAWINGS

The present invention will be described with reference to the accompanying drawings, in which.

DETAILED DESCRIPTION OF THE INVENTION

Figure 1:
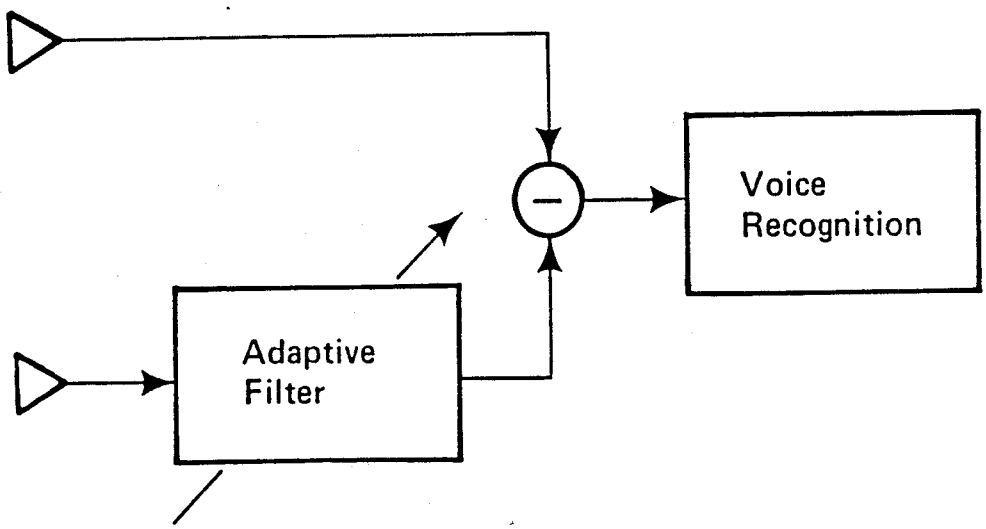
FIG. 1 (PRIOR ART)
FIG. 1 is an illustration of a conventional noise cancellation circuit that has become an industry standard.

In FIG. 1 of the drawings, the conventional, or "standard", noise cancellation technique is illustrated in the form it was introduced first by Bernard Widrow et al. in 1975, and is identified generally by the reference numeral 10. As a system, this technique is considered usually as the input for a voice recognition system. Noise cancellation is performed in a substract circuit 11 between one signal received directly from one microphone 12 and the output from a second microphone 13 after it is passed through an adaptive filter 14. The output from the substract circuit 11 is connected directly to a voice recognition system 15.

The outputs from the two microphones 12 and 13 cover the entire audible voice frequency range; for example, from 100 to 3,200 Hz. The single adaptive filter 14 in this standard technique, therefore, must be capable of performing effectively over the entire audible voice frequency range.

The adaptive filter 14 in the conventional technique must provide compensating amplitude and phase capabilities that vary greatly from one end of the voice frequency range to the other end. In addition, such an adaptive filter 14 would require a large number of adjustable elements; for example, 100 tap coefficient adjustments, or just "taps", all of which leads to problems, such as:

(1) The adjustment of a large number of control elements (using the conventional gradient method, or the like) is a very slow process.

(2) Efforts to speed up the process of working with a large number of control elements can produce other problems, such as numerical instability due to truncation errors, rounding errors, statistical averaging errors, etc.

Noise that is detected by the microphones 12 and 13 from a single, localized source will be the same "noise" at each microphone; that is, it will be the same frequency or frequencies, but it will be displaced in time due to differencies in length of the paths it must travel. This is the meaning of the term "correlated" as applied to the two noise frequencies.

It is an important function that is performed by the adaptive filter 14, therefore, when it compensates for the differences in time between the two noise frequencies. It is this compensation between the two signals that results in an effective cancellation when they are combined in the substract circuit 11.

When the circuit illustrated in FIG. 1, therefore, was tried with noise that was distributed over a region, it was immediately apparent that its performance was degraded seriously relative to its performance with a single localized noise source. Although much effort has been devoted to solving this problem in recent years, none has been effective until the present invention.

Figure 2:
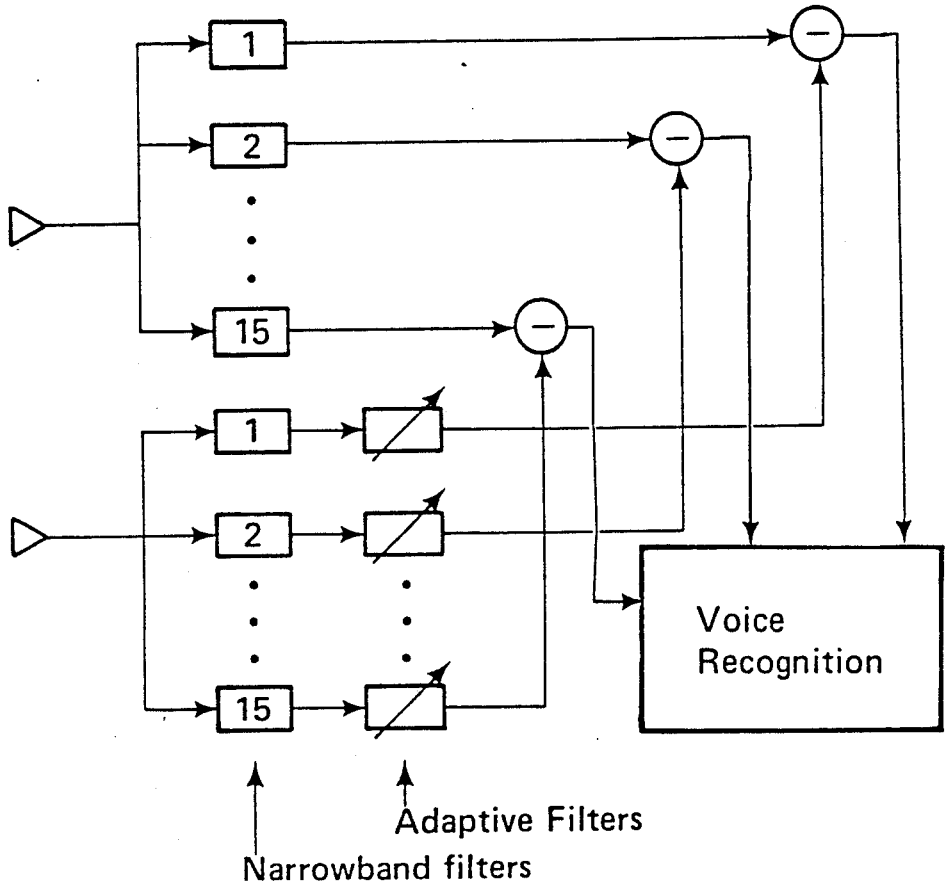
FIG. 2 is an illustration of a noise cancellation system that embodies the features of the invention.

In FIG. 2 of the drawings there is illustrated a circuit arrangement to solve the problem of effectively cancelling the noise from voice, or similar information signals, sufficiently for a voice recognition system to be useful reliably. A noise cancellation system in accordance with the invention is sufficiently effective to be useful in every known environment where noise-degraded speech renders a voice recognition system ineffective; such as, for example, in a factory, on a manufacturing floor, in large office areas, at airports, etc., etc.

Referring now to FIG. 2, a system that is constructed and arranged in accordance with the principles of the invention is identified generally by the reference numeral 16. Two standard sensors 17 and 18, that are readily available commercially, such as, for example, microphones, are located so that the sensor 17 detects both voice and noise. It is contemplated that the sensor 17 will be located so that it will detect as much voice as possible, even though that signal is degraded by noise.

The sensor 18, however, is located so that it will detect principally noise and very little of the voice. When used in a pilot's environment, the sensor 17 is located inside of the pilot's oxygen facemask and the sensor 18 is located outside the oxygen facemask. In other environments, where a wire-like headset is used, the sensor 17 is located close to the mouth of a speaker, and the sensor 18 is located also on the headset but as far as possible from the mouth of the speaker and is pointed in such a way that it detects principally noise. It is important to note, however, that the distance between the two sensors 17 and 18 is quite small, a matter of inches, so that the two sensors pick up effectively the same noise but displaced relative to each other a small amount.

The signals detected by each of the sensors 17 and 18 are connected to a suitable device to divide them into a number of frequencies. For example, each signal is divided into a predetermined number of frequency signals having limited bandwidths, and in FIG. 2, the number that is illustrated is 15.

In FIG. 2, the signal output from each of the sensors 17 and 18 is connected to 15 respective narrowband filters. It is important that the same number used for one sensor be used for the other. The narrowband filters that are connected to receive the signal output from the sensor 17 are in a group that is identified generally by the reference numeral 19, and the narrowband filters that are connected to receive the signal output from the sensor 18 are in a group that is identified generally by the reference numeral 20.

Since the usual frequency range for the voice signals spans approximately 3 kHz (or 3000 Hertz), by dividing this range into 15 different bandwidths, each one of the narrowband filters in the two groups 19 and 20 will be approximately 200 Hertz wide in this example. In tests that have been made on this technique, the voice frequency has been divided into as many as 25 different narrowband frequencies with exceptional results, a good range for the number of narrowband filters being about 10 to about 25. This range covers most instances of their use.

Any particular number of narrowband filters 19 and 20 may be used, or to be more accurate, the signal output from each sensor 17 and 18 can be divided into any number of signals. It is important, however, that the number of the divisions be the same for the signals from the two sensors 17 and 18, because one of these group of divided signals is subtracted from the other to provide a substantially noise-free voice signal.

Each of the narrowband filters in the group 20 is connected to an adaptive filter in a group that is identified by the reference numeral 21. Each of the adaptive filters in the group 21 functions to compensate for the amplitude and phase differences in the signal detected by the sensor 18. By this means, when each of the divided signals is combined in each circuit in a group that is identified by the reference numeral 22, the noise signal from the sensor 18 is subtracted from the voice-plus-noise signal from the sensor 17 to provide the substantially noise-free voice signal.

While each circuit in the group 22 is indicated as being a "subtract" circuit, it will be apparent to one skilled in the art that other procedures are available for obtaining a "difference" action, such as, the signals from the adaptive filters 21 can readily be inverted and then "added" to the voice-plus-noise signal from the narrowband filters 19. Other ways of obtaining a difference action also will give a similar result.

The output from each of the individual subtract circuits in the group 22, as illustrated in FIG. 2 of the drawings, is connected to a voice recognition system 23. With a system 16 constructed and arranged in accordance with the present invention, the voice recognition system 23 has no difficulty responding to spoken commands in noisy environments and even with noises that are distributed over a wide region.

Figure 3:
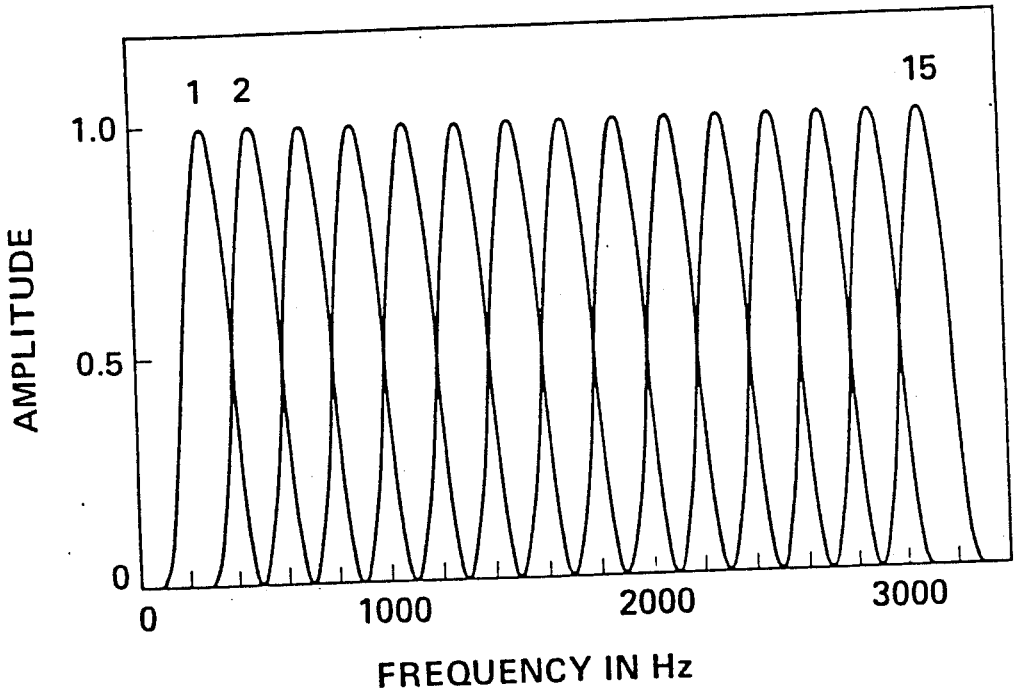
FIG. 3 is a curve for use in describing the operation of the system of the invention.

FIG. 3 of the drawings illustrates a waveform to show this division of the signal from either sensor 17 or 18 into individual component frequencies. For example, the entire curve in FIG. 3 can be an illustration of the output signal from either one of the sensors 17 or 18. The number "1", identified also by the reference numeral 24, is illustrative of a signal that is divided by the narrowband filter in either group 19 or 20.

Similarly, the reference numeral 25 in FIG. 3 identifies the number "2" that corresponds to the narrowband filter "2" in either the group 19 or 20, in FIG. 2, and the reference numeral 26 identifies the number "15" that corresponds to the narrowband filter "15" shown in either group 19 or 20, also in FIG. 2. Therefore, in accordance with the present invention, the noise cancellation system 16, FIG. 2, divides the total signal that is detected by each of the sensors 17 and 18 into a plurality of narrow band frequencies each of which covers only a small fraction of the total signal frequency.

Of course, this dividing of the total signal into a plurality of smaller frequencies may be accomplished through a variety of hardware component parts. For example, it is always acceptable to use a plurality of individual narrowband filters, but the presently preferred way the division is accomplished is by means of a computer, because a computer permits the number of the divided frequencies to be changed readily and quickly.

Tests that have been performed on the invention show that it is possible to obtain a substantially noise-free signal by dividing the total signal into a predetermined number of individual frequencies before the cancellation is attempted. By dividing the noise signal into a plurality of narrow bands, then there is less noise in each narrow band. Now, it has been discovered that it is much easier to cancel the noise by this division technique.

A system arranged in accordance with the invention has the following unique advantage. Since each individual adaptive filter in the group 21, FIG. 2, must compensate for only the frequency in its own narrow band, each of the adaptive filters in the group 21 of the invention needs only a small number of adjustable elements; such as, 4 tap coefficients, for example. Now, it will be more readily apparent that such an adaptive filter as needed in a system of the invention can be adjusted easily, rapidly and much more accurately.

The system of the present invention, therefore, offers a solution to a problem that has been heretofore impossible technically. Moreover, published statements by researchers in this field indicate that they are considering other and materially different arrangements to solve the problem of cancelling noise from distributed sources.

Having described the invention completely with reference to the presently preferred embodiment, it will be apparent to those skilled in this art that modifications and changes can be made, but it is understood that all such modifications and changes that come within the spirit and scope of the claims appended hereto are within the present invention.

What is claimed is:

1. A noise cancellation system for increasing the effectiveness of a voice recognition device in a distributed noise environment, comprising:

two sensors to detect voice and noise frequencies, one of said sensors being located to detect voice plus noise frequencies, and the other of said two sensors being located to detect principally noise frequencies;

two groups of narrowband filters, one group of narrowband filters being connected to said one of said sensors, and the other group of said two groups of narrowband filters being connected to said other of said sensors;

a plurality of adaptive filters, one adaptive filter being connected to receive an output from each narrowband filter in said other group of narrowband filters;

means including subtract circuit means connected to combine corresponding outputs from said plurality of adaptive filters and said one group of narrowband filters; and voice recognition means connected to receive the combined corresponding outputs from said means including subtract circuit means to function principally on voice frequencies.

2. A noise cancellation system as defined in claim 1 wherein said two groups of narrowband filters divide the output of each respective sensor into substantially the same number of individual frequency bands.

3. A noise cancellation system as defined in claim 2 wherein said two groups of narrowband filters divide the output of each respective sensor into approximately fifteen individual frequency bands.

4. A noise cancellation system as defined in claim 2 wherein said two groups of narrowband filters divide the output of each respective sensor into a frequency range of approximately 200 Hertz for each narrowband filter.

5. A noise cancellation system as defined in claim 2 wherein said two groups of narrowband filters divide the output of each respective sensor into approximately 10 to 25 equal frequency bands.

6. A method for cancelling noise from a noise-degraded voice signal in a distributed noise environment, comprising:

detecting a noise-degraded voice signal by placing a first sensor so that a voice component of said noise-degraded voice signal will be dominant over a noise component;

locating a second sensor to detect a signal that is predominately said noise component, and so that a difference in phase displacement between said noise component in said noise-degraded voice signal and said noise component detected by said second sensor is small;

dividing each of said detected signals into a plurality of narrowband frequency bands;

connecting said predominately noise component signal, after it is divided into said plurality of narrowband frequency bands, to a plurality of adaptive filters equal in number to the number of narrowband frequency bands of said predominately noise component signal; and processing said divided narrowband frequency bands of said first sensor with corresponding predominately noise component signals from said adaptive filters to obtain a voice signal that is substantially noise free.

7. A method of cancelling noise from a noise-degraded voice signal as defined in claim 6 wherein the step of dividing said detected signals into a plurality of narrowband frequency bands includes the step of dividing them into approximately 200 Hertz each.

* * * * *